US006619172B2

(12) United States Patent
Nichols et al.

(10) Patent No.: US 6,619,172 B2
(45) Date of Patent: Sep. 16, 2003

(54) TEMPLATE TRACING CUTTER

(75) Inventors: Travis R. Nichols, Tremonton, UT (US); W. Blake Gustafson, Salt Lake City, UT (US)

(73) Assignee: Mimix, Lovell, WY (US)

( * ) Notice: Subject to any disclaimer, the term of this patent is extended or adjusted under 35 U.S.C. 154(b) by 0 days.

(21) Appl. No.: 09/906,429

(22) Filed: Jul. 16, 2001

(65) Prior Publication Data

US 2001/0045018 A1 Nov. 29, 2001

Related U.S. Application Data

(62) Division of application No. 09/318,203, filed on May 25, 1999.

(51) Int. Cl.[7] ..... B26B 1/02

(52) U.S. Cl. ..... 83/565; 30/294; 30/317; 30/321; 30/329; 30/337

(58) Field of Search ..... 83/565, 745, 747, 83/582, 698.11, 698.41, 699.51, 821; 30/289, 290, 294, 314, 317, 320, 315, 310, 164.9, 164.95, 293, 331, 321, 286; 33/11–16, 18.1, 27.12, 42, 562, 566

(56) References Cited

U.S. PATENT DOCUMENTS

| | | | | | |
|---|---|---|---|---|---|
| 1,723,106 | A | | 8/1929 | Wiglenda | |
| 2,314,327 | A | * | 3/1943 | Drake | 266/64 |
| 2,569,286 | A | * | 9/1951 | Bunker | 279/8 |
| 2,728,988 | A | | 1/1956 | Young | 33/23 |
| 2,902,760 | A | * | 9/1959 | Koenig | 30/164.9 |
| 2,902,761 | A | * | 9/1959 | Koenig | 30/164.9 |
| 3,011,258 | A | * | 12/1961 | Kotchan | 30/367 |
| 3,080,653 | A | | 3/1963 | Dolin | 30/317 |
| 3,289,716 | A | | 12/1966 | Dutot | 144/134 |
| 3,555,944 | A | * | 1/1971 | Imamura | 33/27.12 |
| 3,572,202 | A | | 3/1971 | Gerber et al. | 83/146 |
| 3,576,148 | A | | 4/1971 | Katz | 83/455 |
| 3,608,192 | A | * | 9/1971 | Hansel | 30/310 |
| 3,628,407 | A | * | 12/1971 | Adams | 83/140 |
| 3,787,968 | A | | 1/1974 | Littmann | 30/124 |
| 3,797,340 | A | | 3/1974 | Pereman | 83/12 |
| 3,886,656 | A | * | 6/1975 | Meshulam et al. | 30/164.9 |
| 3,922,784 | A | * | 12/1975 | Prince et al. | 30/317 |
| 3,977,077 | A | * | 8/1976 | Rebold | 30/151 |
| 4,012,975 | A | | 3/1977 | LaLone | 83/140 |
| 4,030,195 | A | * | 6/1977 | Insolio | 30/164.9 |
| 4,073,056 | A | | 2/1978 | Schaeffer et al. | 30/123.5 |
| 4,110,907 | A | * | 9/1978 | Einhorn et al. | 225/96 |
| 4,287,669 | A | * | 9/1981 | Arai | 30/123.3 |
| 4,301,594 | A | * | 11/1981 | Okada | 30/164.95 |
| 4,338,718 | A | * | 7/1982 | Olkkola | 30/171 |
| 4,383,460 | A | | 5/1983 | Schotter et al. | 83/886 |
| 4,451,981 | A | | 6/1984 | Kaniarz | 30/123.3 |
| 4,515,051 | A | | 5/1985 | Phillips | 83/146 |
| 4,534,348 | A | * | 8/1985 | Fedorov et al. | 30/320 |
| 4,885,004 | A | * | 12/1989 | Pao | 30/317 |
| 4,934,054 | A | | 6/1990 | Morozumi | 30/293 |
| 5,175,934 | A | | 1/1993 | Chao | 30/329 |
| 5,501,015 | A | * | 3/1996 | Harvey | 30/164.9 |
| 5,823,086 | A | | 10/1998 | McCormick | 83/565 |
| 6,082,008 | A | * | 7/2000 | Lariviere, Jr. | 30/289 |
| 6,158,133 | A | * | 12/2000 | Carlson et al. | 33/27.01 |

* cited by examiner

*Primary Examiner*—Boyer D. Ashley
(74) *Attorney, Agent, or Firm*—Kirton & McConkie; Michael F. Krieger

(57) ABSTRACT

The present invention relates to a media cutting tool for use with a template. The apparatus of the present invention maintains proper alignment with a template through the use of a novel offset, rotating, cutting blade and guards against skipping along the cut as the apparatus is drawn around a template through the use of a novel guide mechanism which engages the template being traced. The present invention also employs a transparent handle for an improved view of the cutting area.

5 Claims, 4 Drawing Sheets

TEMPLATE TRACING CUTTER

RELATED APPLICATION

This application claims priority as a Divisional application to U.S. patent Ser. No. 09/318,203, copending, filed on May 25, 1999, entitled "Template Tracing Cutter."

FIELD OF THE INVENTION

The present invention relates generally to the field of cutting instruments for paper, card stock, mylar, plastic sheeting, cardboard, and other thin media. More particularly, the present invention relates to cutting instruments which follow the shape of a template in order to cut a piece of the thin media in the shape of the template. Templates of this kind often have intricate shapes with corners and curves which are difficult to negotiate with a knife or other simple manual cutter. The present invention uses a novel swivel-offset blade and a specially designed guide to more easily and effectively follow the contour of an intricate template thereby making a more accurate replica of the template shape without tearing, excessive under-cutting or template jumping.

BACKGROUND

Templates are often used to reproduce an object with a specific shape. Current methods include tracing with a pencil or pen and then cutting with scissors or using a straight edge knife such as hobby knife to cut the shape directly from the template. When the reproduced object shape is a simple polygon, the template may simply be a straightedge, which is placed along each edge of the object as it is cut or traced. More complex shapes require a template, which may have multiple curves, circular holes or holes of other shapes, acute angles and other intricate and complex shapes. A straight-bladed knife works well for simple polygonal shapes with straight sides, however cutting complex and intricate shapes with a simple straight blade can require repeated lifting and repositioning of the blade which can often result in cutting the template. Blade repositioning can often lead to template movement, jagged edges and over-cutting where the blade cuts past a corner point. Repositioning can also cause skipping where the cut does not extend to an intended intersection or corner. This leaves skipped spots in the cut, which can rip and damage the media being cut. Often, a person cutting around a detailed template must lift the knife and reverse the cutting direction in order to cleanly and completely cut an inside corner or other complex intersection.

An accurate cut must also follow the template exactly. If a knife blade varies from a direction parallel with the adjacent edge of the template, the knife blade may stray away from the template or cut into the template yielding a product with irregularities that does not reproduce the template shape. In order to accurately and consistently keep the knife blade parallel with the template edge, the knife operator must constantly change the blade direction based on her visual reference to the template. When cutting at high speeds, this can be difficult if not impossible.

Templates are often used for art and craft projects where matting, decorative paper, Mylar, laminating sheets, foil and other media are common. They may also be used with adhesive sheets, leather, upholstery material, cloth and other textiles or plastic products. With a template these media may be repeatedly cut into myriad intricate and identical shapes, so long as the template shape is accurately and consistently followed.

With a visual reference to the cut so important in achieving an accurate cut, some prior art knives with bulky handles are troublesome as they obscure the cut area from the operator's view. Narrow handles, however, often provide an inadequate grip and may cause blistering or soreness with repeated use.

SUMMARY AND OBJECTS OF THE INVENTION

The present invention relates to a template-following cutter designed to accurately cut a thin medium while following the shape of a template and provide the user with a comfortable grip and a clear view of the cut. Embodiments of the present invention comprise a handle with a swiveling knife mechanism and a template following guide mounted on one end. A transparent handle is provided so that the user can view the cut area through the handle of the cutter thereby providing the user with an unobstructed view. The handle is also shaped with a cross-section that comfortably fits the average hand so that the cutter can be comfortably and easily drawn around templates for sustained periods. The comfortable grip also aids in cutting thicker or tougher materials that require additional force to cut.

In some embodiments of the present invention, the swiveling knife mechanism preferably utilizes a bearing to enhance rotation. The knife mechanism also comprises a knife offset wherein the knife blade is offset from the axis of rotation of the swivel mechanism so as to cause the knife to automatically align itself in the direction being cut parallel to the template being traced. This knife mechanism also comprises a knife blade with a blade angle designed specifically to enhance blade alignment and reduce ripping of the media being cut. The knife mechanism is also made as a removable cartridge so that a dull or damaged blade may be easily replaced and so blades for different mediums may be easily interchanged.

The template following guide comprises a guide shaft mechanism that guides the blade along the edge of the template being traced, and a guide foot mechanism that lifts the template from the medium being cut so as to guide the template to properly contact the guide shaft. The template following guide may be attached directly to the knife mechanism or to the handle. The template following guide is configured such that it minimizes the amount of undercut and maximizes automatic blade alignment.

Consequently, it is an object of preferred embodiments of the present invention to provide a cutter that provides an unobstructed view of the cut area.

It is another object of preferred embodiments of the present invention to provide a cutter with a transparent handle.

It is an additional object of preferred embodiments of the present invention to provide a cutter with a comfortable handle.

It is a further object of preferred embodiments of the present invention to provide a cutter that automatically follows a path that is parallel to the template being traced.

It is yet another object of preferred embodiments of the present invention to provide a cutter with a blade that freely rotates so as to easily align with the cutting direction in order to facilitate clean cutting and to minimize tearing caused by a misaligned blade.

It is a once further object of preferred embodiments of the present invention to provide a cutter with a blade angle and/or curvature-that minimizes ripping of the media being cut and maximizes smooth template following.

It is another additional object of preferred embodiments of the present invention to provide a cutter with a guide that prevents the cutter from jumping over or cutting the template.

It is yet another additional object of preferred embodiments of the present invention to provide a cutter with a blade and guide combination that allows a medium to be cut directly beneath the template being traced.

It is once further another additional object of preferred embodiments of the present invention to provide a cutter with a blade and guide combination that controls the offset between the blade and the template being traced.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. With the understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

Figure 1:
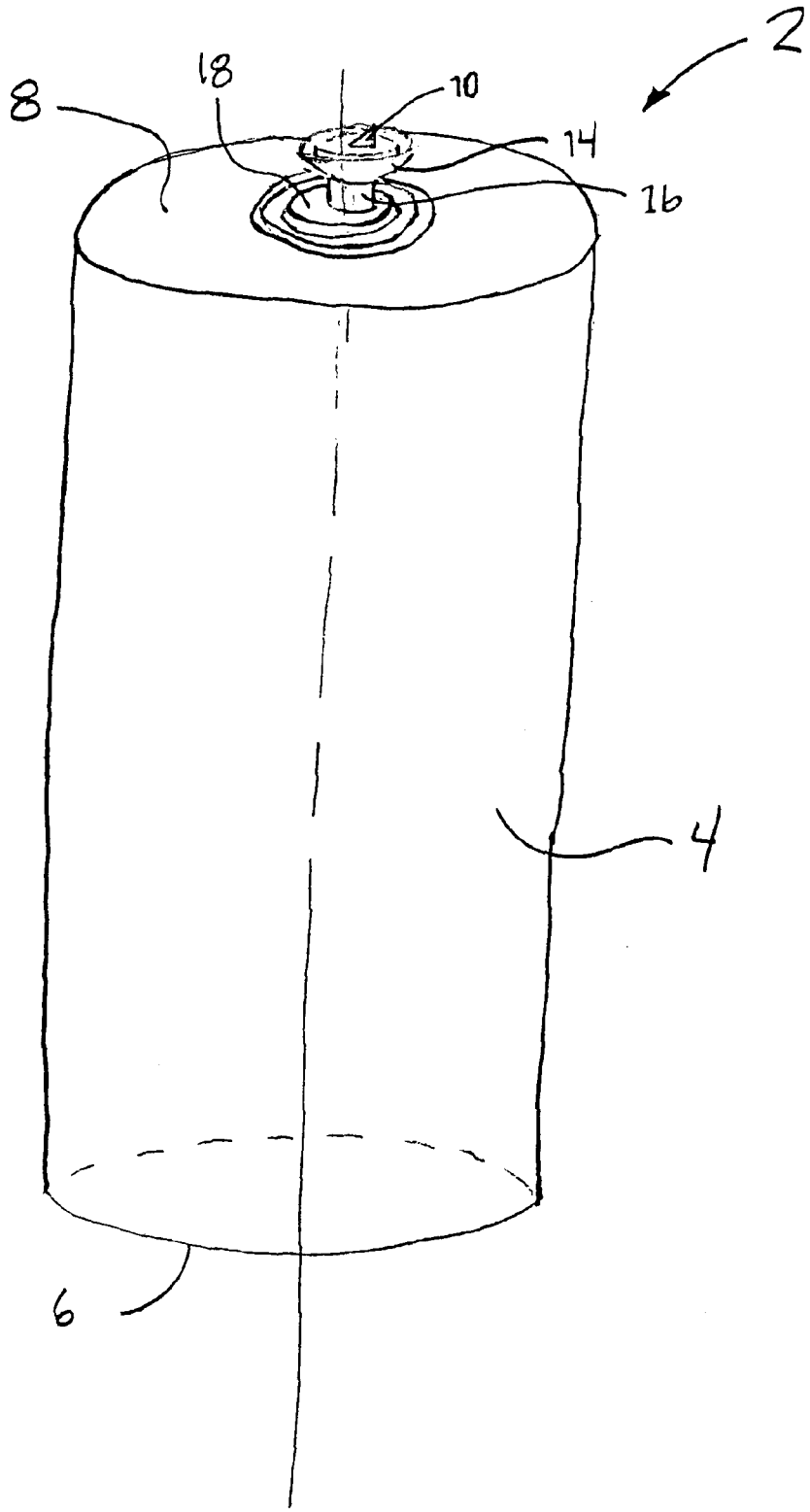
FIG. 1 is a perspective view a first embodiment of the present invention.

A preferred embodiment of the present invention comprises a cutter 2 with a cylindrical handle 4 having a round cross-section as shown in FIG. 1. The cross-section of handle 4 may be formed in other shapes. For example, and not by way of limitation, handle 4 may have a hexagonal, octagonal, elliptical or other polygonal or circular variations as well as other shapes that conform to the hand for a comfortable and sure grip. Handle 4 is constructed from transparent material so that a user may see through handle 4 in the longitudinal direction thereby revealing an unobstructed view of the cutting area. The cross-sectional dimensions of handle 4 may vary and various sizes may be made to accommodate different size hands. The average cross-sectional dimension for various users typically ranges between 0.75 inches and 1.75", however a preferred cross-sectional dimension which will accommodate the majority of users is 1 inch.

The length of handle 4 may vary as well and effective lengths may range between approximately 2 inches and 4 inches, however a length of 3 inches has been found to be comfortable for most users.

In a preferred embodiment of the present invention, cutting end 8 and butt end 6 of handle 4 are flat and substantially perpendicular to the longitudinal axis of handle 4. In other preferred embodiments, the ends 6 and 8 of handle 4 may be shaped otherwise. Ends 6 and 8 may be shaped to form a lens thereby providing magnification of the cutting area. Cutting end 8 may also be shaped with a taper so as to provide better visibility of the cutting area from a side or perspective view. Butt end 6 may also be shaped as a hemisphere or otherwise rounded for comfort or aesthetic appeal.

Handle 4 may be constructed of any transparent material. A preferred material is acrylic. Other suitable materials are polycarbonate and styrene.

In a preferred embodiment of the present invention, the cylindrical shape of handle 4 and the perpendicular, substantially planar shape of cutting end 8 with its close proximity to the cutting blade inhibit the user from viewing the cutting area from a lateral position. This inhibited view is desirable as a user viewing the cutting area from the side tends to tilt the cutting apparatus to improve her view. This tilting results in an uneven and inaccurate cut as the blade wanders from the template shape. The cylindrical shape and perpendicular cutting end 8 coax the user to hold the cutting apparatus perpendicular to the template thereby improving the accuracy of the cut.

Handle 4 further comprises a cavity 32 which has a wider section 36 for receiving a bearing carrier 24. Cavity 32 also contains a narrower section 38 which allows stem 20 to rotate freely within handle 4. Shoulder 34 transitions between wider section 36 and narrower section 38. In a preferred embodiment, shoulder 34 allows for precise placement of bearing carrier 24, however cavity 32 may be formed with a single width or diameter and bearing carrier 24 may be suitably fitted therein by interference fit, threads, cement or other leans without the use of shoulder 34. Cavity 32 will preferably have a circular cross-sectional area to accommodate typical bearings available for this type of application, however the cross-sectional area may have different shapes so long as a swivel mechanism can be fitted therein.

A preferred embodiment of the present invention utilizes a ball bearing with outer carrier 24, balls 26 and inner bearing ring 22 to provide smooth rotation of the cutting mechanism. Other bearing types that may be used include, but are not limited to roller bearings, shell bearings and others. Regardless of the type of bearing used, the bearing carrier or exterior portion must be firmly fitted to the handle 4. This may be achieved through an interference fit, chemical bonding, heat bonding or other means. In a preferred embodiment the bearing is installed with an slight interference fit and then flame polished into place. This process firmly locks the bearing in place and also puts a fine polish on cutting end 8 to reduce friction with the template.

Stem 20 forms an interference fit within inner bearing ring 22. This fit may be achieved through an interference fit tolerance on the full circumference of the stem 20 and bearing ring 22 or it may be achieved by using ribs on the exterior surface of stem 20 that interfere with the inner surface of inner bearing ring 22. In a preferred embodiment of the present invention, stem 20 is interference fit into inner bearing ring 22 such that stem 20 may be removed from bearing ring 22 by hand. This fit allows convenient removal and replacement of the stem 20 and attached cutting mechanism when blades are dull or broken or when a blade for a different medium is desired. Other removable attachment means such as threads, snap-fit means and others may also be used.

Figure 2:
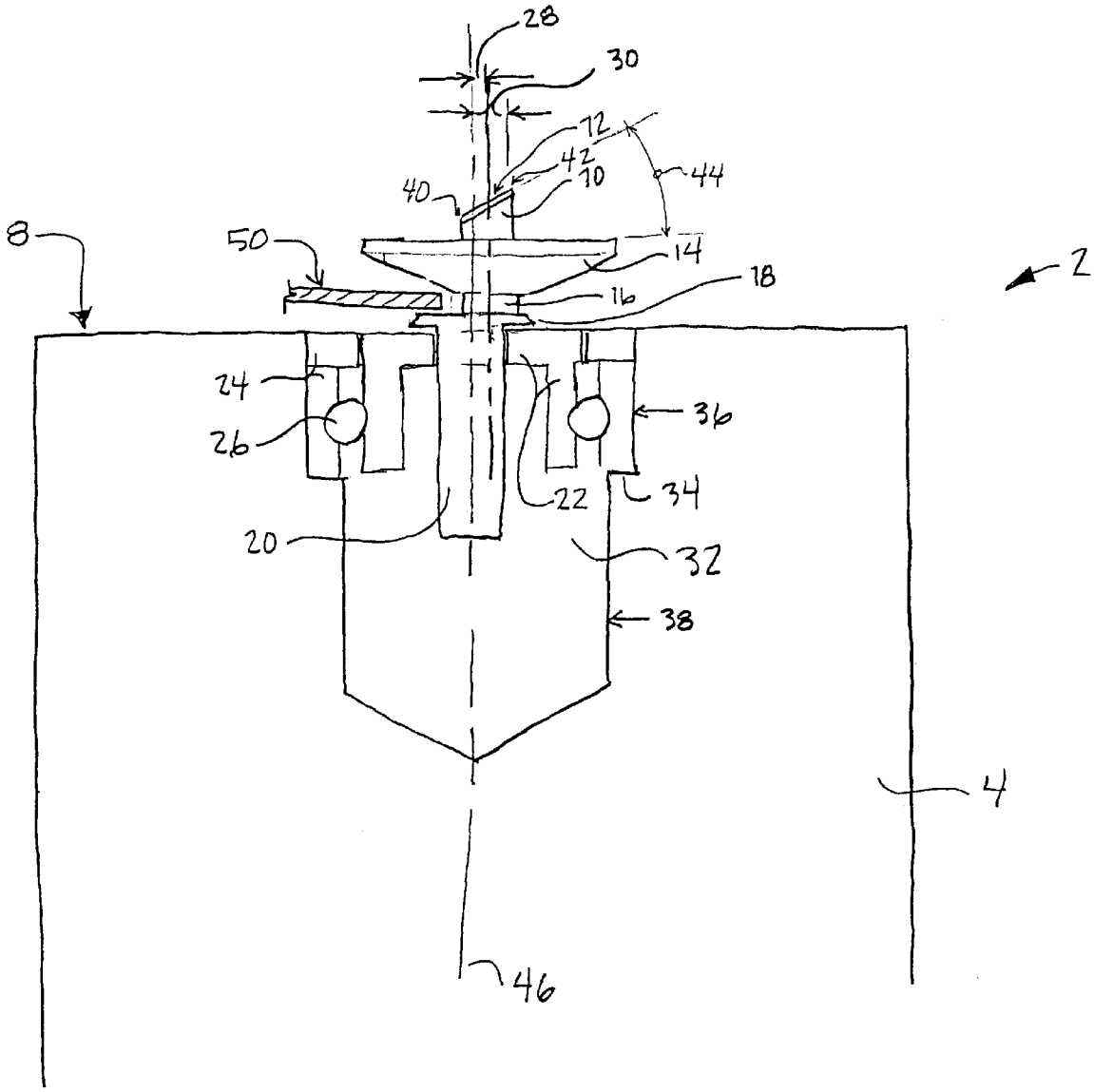
FIG. 2 is a cross-sectional view of a first embodiment of the present invention.

At one end of stem 20 is flange 18 which provides a stop for stem 20 and a widened base for the attachment of guide shaft 16. Guide shaft 16 keeps the blade at a constant distance from the template being cut. Guide shaft 16 has a circular cross-section and is oriented in relation to stem 20 such that the centroidal axis of guide shaft 16 is parallel but offset from the centroidal axis of stem 20. This offset, shown in FIG. 2 at 28, allows the diameter of guide shaft 16 to be minimized, thus decreasing template undercut, while maintaining the blade offset shown at 30 that is required to maximize automatic blade alignment. Decreasing the diameter of guide shaft 16 and maintaining trailing edge 42 near the centroidal axis of guide shaft 16 allows blade 10 to more closely cut the shape of a complex and intricate template especially when cutting through an inside corner. While shaft offset distance 28 may vary to accommodate different cutter sizes and blade configurations, the offset distance found to work best for most applications is 0.02 inches.

Guide foot 14 is attached to guide shaft 16 at a distance that allows for the thickness of the templates being used. This distance may vary for different applications and templates. Guide foot 14 extends radially outwardly from shaft 16 forming a conical shape. This guide foot 14 rides below the template when the cutter is in use and guides the template into proper contact with guide shaft 16. The conical shape engages and lifts the template as the cutter approaches corners and other intricate shapes that might otherwise contact the edge of the guide foot causing the guide to bind on the edge of the template and then skip out of the template as the cutting direction is changed. The outermost diameter of guide foot 14 is typically 0.25 inches while the innermost diameter where the guide foot 14 meets shaft 16 is typically 0.08 inches for a typical paper media cutter. These dimensions may vary for cutters tailored for heavier media, but have been found to work best for cutting paper media.

Cutting blade 10 is attached to guide foot 14 or is attached to guide shaft 16 and protrudes through guide foot 14. It should be noted that stem 20, flange 18, guide shaft 16 and guide foot 14 may be integrally formed as one unit or assembled from sub units. These units may be composed of a material such a nylon or another high-strength plastic-like substance. It may also be machined or otherwise constructed from aluminum or another metal substance. In a preferred embodiment, nylon is used for this unit. Therefore, cutting blade 10 may attach to guide foot 14, guide shaft 16, flange 18, stem 20, or the integral unit which comprises these elements.

It should also be noted that flange 18 may be made very thin or recessed into the surface of cutting end 8 of handle 4. Flange 18 may also be omitted when stem 20 is wide enough to accommodate the direct attachment of shaft 16 with an appropriate offset 28 and when an alternate method is used to stop stem 20 from pushing too deeply into inner bearing ring 22.

Blade 10 has a cutting edge 12, which tapers from a leading or proximate edge 40 to a trailing or distal edge 42. The shape of cutting edge 12 may vary depending on the media to be cut. For thicker media, such as card stock or even cardboard a steep angle with a straight edge is preferred. A steeper angle is achieved as angle 44 approaches 90 degrees. As angle 44 approaches 0 degrees a flat angle is achieved. According to this definition, steeper angles are preferred for thicker media.

The shape of cutting edge 12 can also be varied. A straight edge is preferable for thicker media because it reduces ripping and tearing at interior corners of the template. For thin media, such as lightweight papers, a rounded, convex edge with a flatter angle is preferred.

Blade 10 is oriented so that the cutting point along the cutting edge 12 where cutting edge 12 contacts the media to be cut, typically near trailing edge 42, is also offset from the centroidal axis of handle 4. This offset aligns with the offset 28 of guide shaft 16 directionally, but is a greater offset distance. A preferred offset distance 30 between the centroidal axis of handle 4 and the trailing edge 42 of cutting edge 12 is 0.045 inches. This offset has been found to work well for cutting thin paper type media as well as thicker card stock type media.

Figure 3:
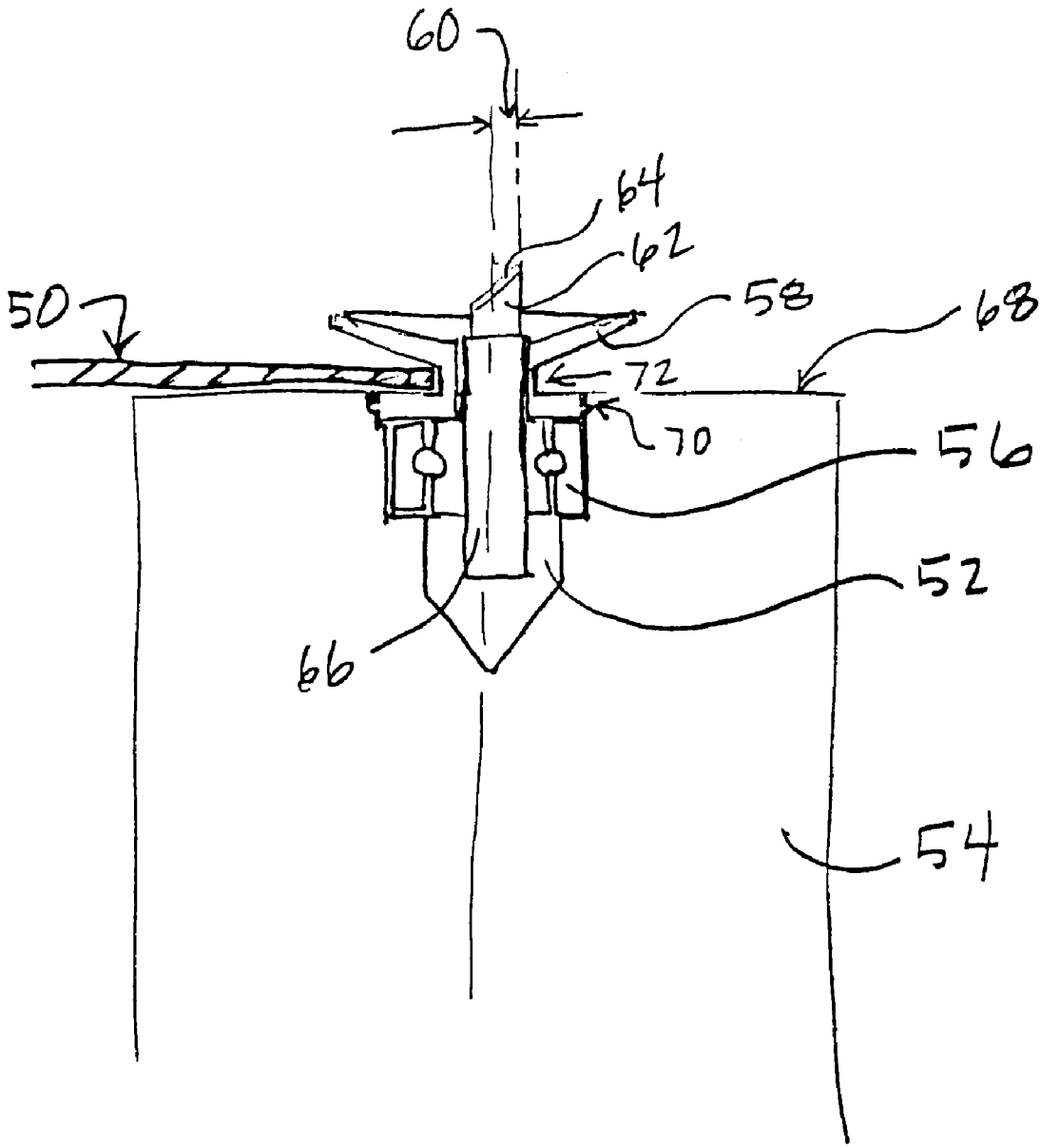
FIG. 3 is a cross-sectional view of a second embodiment of the present invention.

In an alternative embodiment of the present invention as shown in FIG. 3, a stationary guide foot 58 is directly attached to handle 54 through a snap fit, threading or other removable attachment mechanism 70. Blade 62, having blade surface or cutting edge 64, is attached to blade stem 66, which rotates within guide foot 58 and extends into cavity 52 of handle 54. Blade stem 66 attaches to bearing 56 with an interference fit or other removable attachment means so that blade 62 and blade stem 66 may be easily replaced. Bearing 56 allows blade stem 66 to freely rotate within cavity 52 of handle 54 so that blade 62 may align itself with template 50 by virtue of offset 60 and frictional forces as explained below for both embodiments. Guide foot 58 engages below template 50 similarly to guide foot 14 of the previously described embodiment, such that the template 50 may be maintained against the template receiving portion 72 of said guide foot 58.

Figure 4:
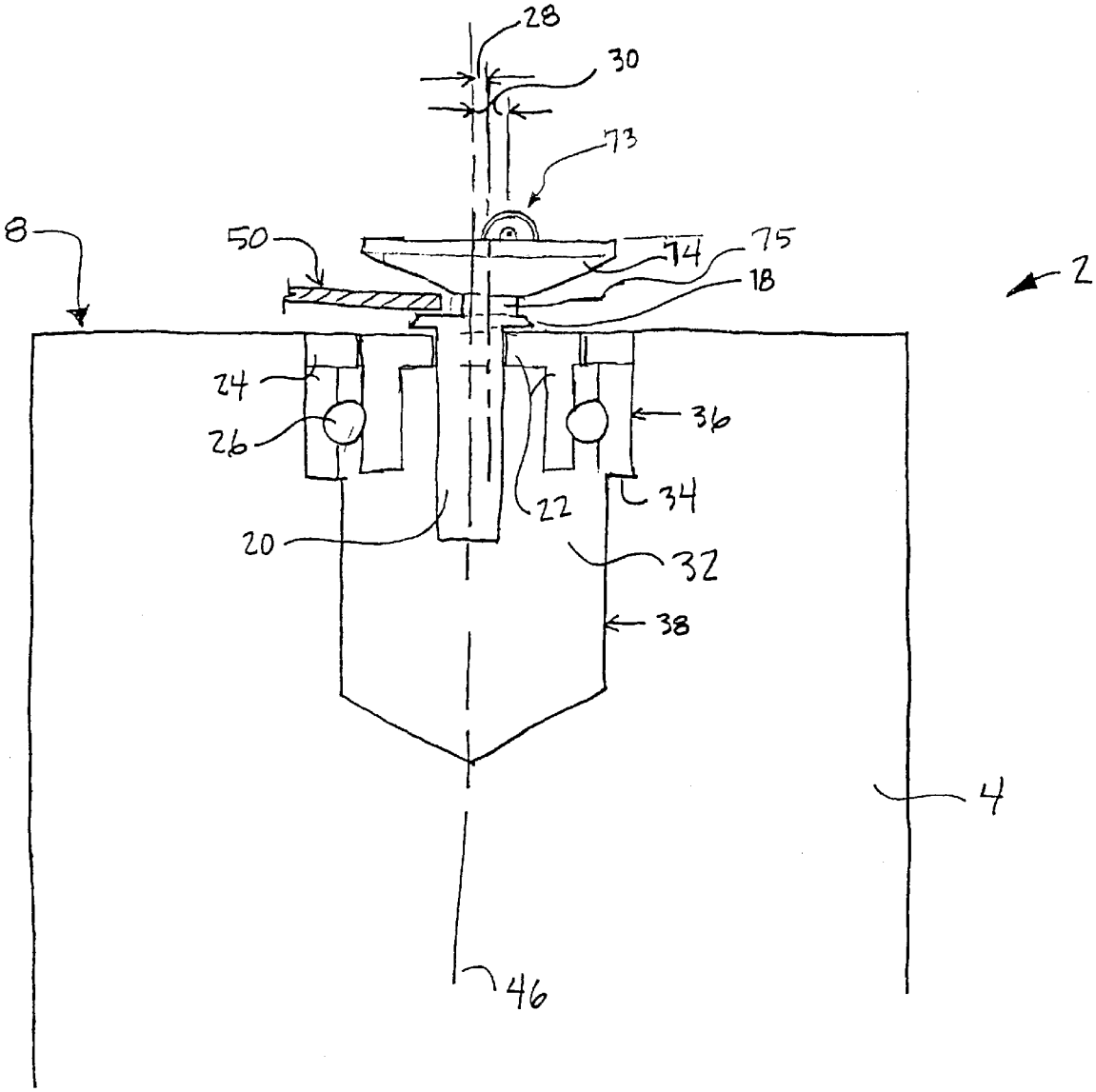
FIG. 4 is a cross-sectional view of a third embodiment of the present invention.

In yet another alternative embodiment of the present invention as shown in FIG. 4, a circular, wheel-like blade 73 that rolls as it cuts is mounted in guide foot 74, which is attached to shaft 75. Blade 73 may also be attached directly to shaft 75. The guide foot 74 of this roller-blade embodiment functions similarly to the guide foot 58 or guide foot 14 of the previously described embodiments.

In normal use, a template is placed above a sheet of paper or other thin media. Template tracing cutter 2 is then brought into contact with template 50 so that guide 14 is slipped under template 50 and shaft 16 is in contact with the edge of template 50. Cutter 2 is then drawn along the edge of template 50 until it makes a complete pass around template 50. As cutter 2 is drawn along the edge of template 50 the offset 30 of cutting edge 12 causes blade 10 to automatically align itself to the direction of cut which is parallel to the adjacent edge of template 50. Essentially, the friction of the paper media on the blade 10 causes the blade 10 to swivel or rotate around bearing axis 46 until the force pulling the cutter 2 along the template 50, which is parallel with the template edge, aligns with the frictional force on the cutting edge 12 of blade 10. These forces pull the trailing edge 42 to a trailing position making the blade 10 parallel with the edge of template 50.

As cutter 2 is drawn through an inside corner, blade 10 must almost instantaneously change from a position parallel with one side of the corner to a position parallel with the other side of the corner. Prior art cutting tools can short cut or round corners, or cause tearing or ripping of the media, or require lifting and repositioning of the cutting tool to cleanly cut through the corner. However the transition is made smoothly by the above embodied cutters due to the swivel action effectuated by the double offset design.

As the cutter 2 is drawn in the new direction away from the corner, frictional forces resist movement of trailing edge 42 while leading edge 40 moves in the direction of the template edge exiting the corner. These forces cause blade 10 to align with the template edge, which exits the corner.

What is claimed is:

1. A cutting device for use with a template, said cutting device comprising:

an elongated handle having a first end, a second end defining a cavity, and a central longitudinal axis; and a blade cartridge disposed within the cavity of the handle such that a central longitudinal axis of the blade cartridge is substantially aligned with the central longitudinal axis of the handle, said cartridge comprising a cutting blade, a conical guide foot located immediately above said blade, a guide shaft located immediately above said guide foot and having a circular cross-section, and a rotatable stem located above said guide shaft, the conical guide foot being shaped to lift an edge of the template and engage the template between said guide foot, said guide shaft, and said second end of said handle, the guide shaft having a central longitudinal axis that is parallel to but offset from said central longitudinal axis of said handle, the edge of the guide shaft serving to contact and thereby guide the template when the cutting device is cutting a medium.

2. The cutting device of claim 1, wherein said offset is about 0.02 inches.

3. The cutting device of claim 1, wherein said central longitudinal axis of said handle is offset by about 0.045 inches from a cutting point existing along said cutting blade, said cutting point being located where said cutting blade contacts the media to be cut.

4. The cutting device of claim 1, wherein said handle is transparent to provide a clear view of said cutting blade when said cutting device is cutting said medium.

5. The cutting device of claim 1, wherein said handle is a magnifier to provide a magnified view of said cut.

* * * * *